US005470685A

United States Patent [19]

Sugawara et al.

[11] Patent Number: 5,470,685

[45] Date of Patent: Nov. 28, 1995

[54] TONER FOR DEVELOPING ELECTROSTATIC IMAGES

[75] Inventors: Shuji Sugawara, Neyagawa; Kazuaki Sukata, Yawata; Shun-ichiro Yamanaka, Hirakata, all of Japan

[73] Assignee: Orient Chemical Industries, Ltd., Osaka, Japan

[21] Appl. No.: 219,614

[22] Filed: Mar. 29, 1994

[30] Foreign Application Priority Data

Mar. 31, 1993 [JP] Japan ..... 5-098521

[51] Int. Cl.$^6$ ..... G03G 9/097

[52] U.S. Cl. ..... 430/110

[58] Field of Search ..... 430/109, 110, 430/111

[56] References Cited

U.S. PATENT DOCUMENTS 5,350,657 9/1994 Anno et al. ..... 430/109

5,364,721 11/1994 Asada et al. ..... 430/109

*Primary Examiner*—John Goodrow

*Attorney, Agent, or Firm*—McGlew and Tuttle

[57] ABSTRACT

A toner for developing electrostatic images contains at least one complex salt compound obtained by treating with an alkali metal salt, alkaline earth metal salt, alkali metal hydroxide, alkaline earth metal hydroxide, ammonium salt or pyridinium salt, an ether linkage group containing compound of the formula $$A^1—X—[(—L—X—)_m—(—Ar—X—)_n]—A^2 \quad [I]$$

wherein (—L—X—) represents an oxyalkylene group or a thioarylene group, (—Ar—X—) represents an oxyarylene group or a thioarylene group, $[(—L—X—)_m—(—Ar—X—)_n]$ represents a combination of m units of (—L—X—) and n units of (—Ar—X—) bound in a given order, m and n independently represent an integer of 0 or more, and when n is 0, m is 3 or more, and when m is 0, n is 1 or more, X represents —O— or —S—, L represents an alkylene group having 1 to 4 carbon atoms which is branched or not branched or a cycloalkylene group, Ar represents a monocyclic or polycyclic arylene group which does or does not have a substituent or a $—(CH_2)_a—Ax—(CH_2)_a—$ group in which a represents an integer from 1 to 4 and Ax represents a monocyclic or polycyclic arylene group which does or does not have a substituent, and $A^1$ and $A^2$ independently represent hydrogen, an alkyl group, a cycloalkyl group, a monocyclic or polycyclic aryl group which has or does not have a substituent, an aralkyl group or a residue of a nitrogen-containing heterocyclic compound having an —OH group or an —SH group.

24 Claims, No Drawings

TONER FOR DEVELOPING ELECTROSTATIC IMAGES

BACKGROUND OF THE INVENTION

1. Field of the Invention

The present invention relates to a positively chargeable toner for developing electrostatic latent images used for electrophotography, electrostatic recording, electrostatic printing and other purposes.

2. Description of the Prior Art

In copying machines and other equipment based on electrophotography, various dry or wet toners containing a coloring agent, a fixing resin and other substances are used to visualize the electrostatic latent image formed on the photoreceptor having a light-sensitive layer containing an inorganic or organic photoconductive substance.

The chargeability of such toners is the most important factor in electrostatic latent image developing systems. Thus, to appropriately control or stabilize the charge amount of toner, a charge control agent providing a positive or negative charge is often added to the toner.

Examples of charge control agents providing a negative charge for toner in actual application include chromium complex salts, cobalt complex salts, iron complex salts and other salts of azo dyes having a good charge providing property. Examples of charge control agents providing a positive charge for toner in actual application include basic dyes such as nigrosine dyes and triarylmethane dyes. Most of these, however, are relatively densely colored.

For general applicability to color toners of various colors, the charge control agent must be colorless or colored lightly to the extent that the tone of the color toners is not affected. There are a large number of positive charge control agents meeting these requirements, including quaternary ammonium salt compounds (e.g., Japanese Patent Examined Publication No. 54696/1989), pyridinium salt compounds (e.g., Japanese Patent Examined Publication No. 29062/1992), imidazole compounds (e.g., Japanese Patent Open to Public Inspection (hereinafter referred to as Japanese Patent O.P.I. Publication) No. 262555/1989), triazine compounds (e.g., Japanese Patent O.P.I. Publication No. 141072/1988), amine compounds (e.g., Japanese Patent O.P.I. Publication No. 90864/1984) and polyamine resins (e.g., Japanese Patent Examined Publication No. 13284/1978).

Among the toners incorporating conventional positive charge control agents, however, many are unsatisfactory in charge stability in multiple repeated use; for example, the toner charge distribution is uneven due to the poor compatibility or dispersibility of the charge control agent with the toner resin, and the resulting charge is not stably retained due to a lack of environmental stability. Against this background, there is a need of the development of black toners and color toners containing a positive charge control agent improved with respect to such properties.

In recent years, some toners positively or negatively charged by introducing a polar group to the resin itself or by other means have been proposed, but they have various problems to be solved as to chargeability and other properties.

The object of the present invention, developed in view of the above problems involved in prior art methods, is to provide a positively chargeable toner for developing electrostatic images which is versatile for various color toners, including those of the three primaries, and achromatic toners, which is excellent in charge stability to changes in temperature and humidity, i.e., environmental resistance, stability of chargeability over time, i.e., storage stability, and stability of chargeability in multiple repeated use, i.e., durability.

SUMMARY OF THE INVENTION

The present inventors investigated the charge control properties of compounds having an alkali metal ion, alkaline earth metal ion, ammonium ion or pyridinium ion and a number of ether linkage groups capable of interaction with counter ions thereof, and found that the above-described object can be accomplished by a toner incorporating a particular (metal) complex salt compound having 1 or 2 or more oxyalkylene groups, oxyarylene groups or (thio)ether groups in the molecular structure thereof. The inventors made further investigations based on this finding, and developed the present invention.

Accordingly, the toner for developing electrostatic images of the present invention contains at least one complex salt compound obtained by treating a compound represented by formula [I] below, which has an ether linkage group, with an alkali metal or alkaline earth metal salt, alkali metal or alkaline earth metal hydroxide, ammonium salt or pyridinium salt;

$$A^1—X—[(—L—X—)_m—(—Ar—X—)_n]—A^2 \quad [I]$$

wherein (—L—X—) represents an oxyalkylene group or a thioalkylene group;

(—Ar—X—) represents an oxyarylene group or a thioarylene group;

$[(—L—X—)_m—(—Ar—X—)_n]$ represents a combination of m units of (—L—X—) and n units of (—Ar—X—) bound in a given order;

m and n independently represent an integer of 0 or more, and when n is 0, m is 3 or more, and when m is 0, n is 1 or more;

X represents —O— or —S—;

L represents an alkylene group having 1 to 4 carbon atoms which is branched or not branched or a cycloalkylene group;

Ar represents a monocyclic or polycyclic arylene group which has or does not have a substituent or a $—(CH_2)_a—Ax—(CH_2)_a—$ group wherein (a represents an integer from 1 to 4; Ax represents a monocyclic or polycyclic arylene group which has or does not have a substituent);

$A^1$ and $A^2$ independently represent hydrogen, an alkyl group, a cycloalkyl group, a monocyclic or polycyclic aryl group which has or does not have a substituent, an aralkyl group or a residue of a nitrogen-containing heterocyclic compound having an —OH group or an —SH group.

The positively chargeable toner for developing electrostatic images of the present invention is versatile for various color toners, including those of the three primaries, and achromatic toners, excellent in charge stability to changes in temperature and humidity, i.e., environmental resistance, stability of chargeability over time, i.e., storage stability, and stability of chargeability in multiple repeated use, i.e., durability. In addition, it is excellently safe because of the absence of heavy metals.

DETAILED DESCRIPTION OF THE INVENTION

Examples of groups for L and Ar in formula [I] include alkylene groups from (poly)alkylene glycol such as
1,2-ethylene group,
1,2- or 1,3-propylene group (trimethylene group) and
1,2-, 1,3- or 1,4-butylene group,
cycloalkylene groups such as 1,2- or 1,4-cyclohexylene group, and substituted or unsubstituted arylene groups from polyether or (aromatic) diol compounds, such as
1,2-, 1,3- or 1,4-phenylene group,
4-tert-butyl-1,2-phenylene group,
4-chloro-1,2-phenylene group,
4-nitro-1,2-phenylene group,
2,3-naphthylene group and
7-nitro-2,3-naphthylene group.

Examples of groups for $A^1$ and $A^2$ in formula [I] include hydrogen, lower alkyl groups such as methyl, ethyl, propyl and butyl, cycloalkyl groups such as cyclohexyl, aralkyl groups such as benzyl and phenethyl, substituted or unsubstituted phenyl groups from phenols or catechols, such as phenol, o-nitrophenol, p-chlorophenol, o-cresol, tert-butylphenol, p-octylphenol and (thio)catechol, substituted or unsubstituted naphthyl groups from 2-naphthol or 2,3-dihydroxynaphthalene, which is not substituted or substituted by a nitro group, an alkyl group or a halogen atom, and groups from nitrogen-containing heterocyclic compounds, such as 2-hydroxypyridine, 8-hydroxyquinoline and 2-hydroxycarbazole, with preference given to the 8-quinolyl group from 8-hydroxyquinoline.

In the present invention, when X is sulfur, $A^1$ and $A^2$ may be replaced with (poly)thioether, thiophenol, etc., which are included in the technical scope of the invention.

Compounds represented by formula [I] above are known from the literature:

1) Shozo Yanagida et al., Bulletin of the Chemical Society of Japan, Vol. 51(11), 3111, 1978,
2) Burkhard Tummler et al., J. Am. Chem. Soc., 101:10, May 9, 1979,
3) Kazuo Yamaguchi, Bull. Chem. Soc. Jpn. 62, 1097 (1989),
4) Kazuo Yamaguchi, Bull. Chem. Soc. Jpn. 61, 2024 (1988) and
5) Noriko Kasuga, Bull. Chem. Soc. Jpn. 64, 3548 (1991), and can be synthesized by the methods described in these references.

Compounds represented by formula [I] are roughly divided into the following three groups. Assuming that X is —O—, L is an ethylene group and Ar is a phenylene group or

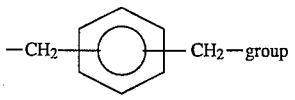

for convenience of explanation, each group is hereinafter specifically described.

Group 1

Linear polyethers (and derivatives thereof) having (—L—X—) and (—Ar—X—) in the molecular structure thereof:

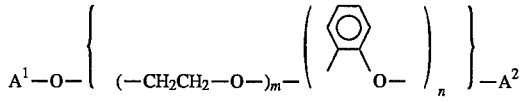

[I-1]: Phenyl for $A^1$ and $A^2$, m=4, n=1

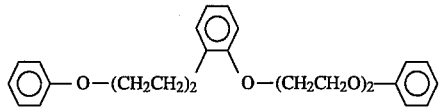

[I-2]: $—CH_3$ for $A^1$ and $A^2$, m=3, n=2

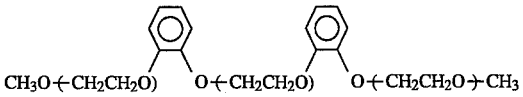

[I-3]: H for $A^1$ and $A^2$, m=4, n=2

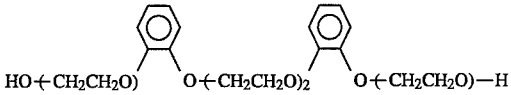

[I-4]: 8-quinoline for $A^1$ and $A^2$, m=4, n=1

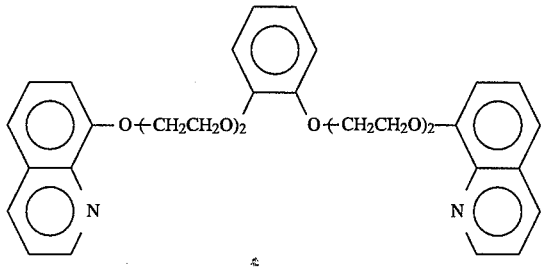

[I-5]: 8-quinoline for $A^1$ and $A^2$, m=2, n=1

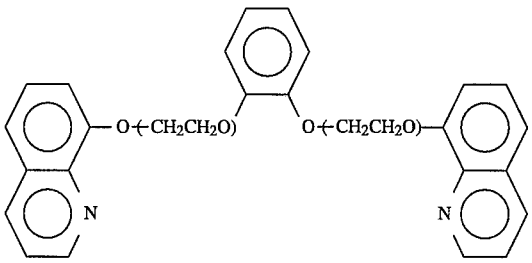

Group 2

Linear polyethylene glycols (and derivatives thereof) having 3 or more units of (—L—X—) in the molecular structure thereof:

$A^1—O—(—CH_2CH_2—O—)_m—A^2$

[I-6]: H for $A^1$ and $A^2$, m=20, n=0

$HO—(CH_2CH_2O)_{20}—H$

[I-7]: $—CH_3$ for $A^1$ and $A^2$, m=6, n=0

$CH_2O—(CH_2CH_2O)_6—CH_3$

[I-8]: H for $A^1$ and $—C_2H_5$ for $A^2$, m=6, n=0

$HO—(CH_2CH_2O)_6—C_2H_5$

[I-9]: Phenyl for $A^1$ and $A^2$, m=4, n=0

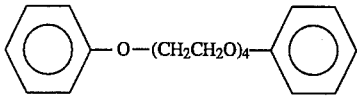

[I-10]: Phenyl for $A^1$ and 8-quinoline for $A^2$, m=4, n=0

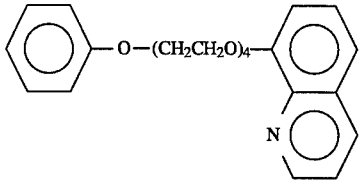

[I-11]: 8-quinoline for $A^1$ and $A^2$, m=4, n=0

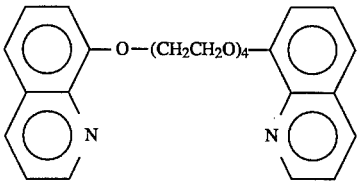

[I-12]: Benzyl for $A^1$ and $A^2$, m=6, n=0

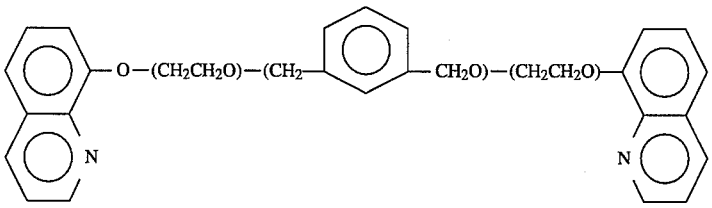

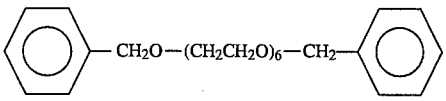

Group 3

Compounds (and derivatives thereof) having 1 unit of

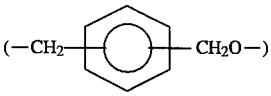

in the molecular structure thereof and a residue of a nitrogen-containing heterocyclic compound having an —OH group (e.g., residue of 8-hydroxyquinoline) for $A^1$ and/or $A^2$:

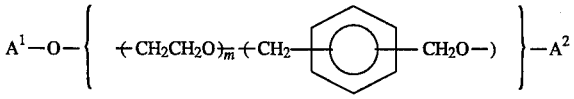

[I-13]: 8-quinoline for $A^1$ and $A^2$, m=0, n=1

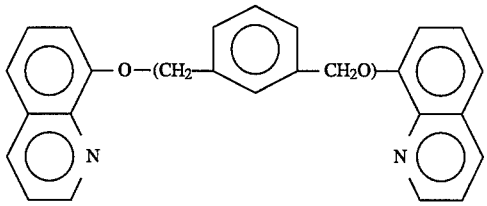

[I-14]: 8-quinoline for $A^1$ and $A^2$, m=2, n=1

[I-15]: 8-quinoline for $A^1$ and $A^2$, m=0, n=1

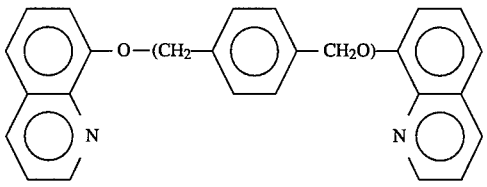

[I-16]: 8-quinoline for $A^1$ and $A^2$, m=2, n=1

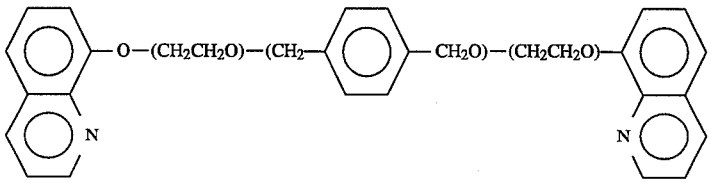

In the present specification, compounds represented by formula [I], which have an (—O—) group or a (—S—) group, are hereinafter referred to as poly(—O—) compounds and poly(—S—) compounds, respectively.

(Metal) complex salt compounds used in the toner for developing electrostatic images of the present invention are obtained by converting poly(—O—) compounds or poly (—S—) compounds as specified above into complex salts with alkali metal salts (e.g., lithium chloride, sodium chloride, potassium chloride, cesium chloride, potassium iodide, rubidium bromide, sodium fluoride, potassium fluoride, potassium thiocyanate, potassium sulfate, potassium methylsulfate, sodium stearate, potassium salicylate), alkaline earth metal salts (e.g., magnesium chloride, barium chloride, magnesium thiocyanate, barium thiocyanate, barium sulfate, magnesium stearate, magnesium silicate), alkali metal or alkaline earth metal hydroxides (e.g., potassium hydroxide, barium hydroxide, magnesium hydroxide), ammonium salts and pyridinium salts (e.g., ammonium thiocyanate, ammonium stearate, ammonium iodide, methylammonium bromide, tetramethylammonium chloride, benzylmethyl-hexadecylammonium chloride, pyridinium iodide). Of these, alkali metal salts, alkaline earth metal salts and ammonium salts of thiocyanic acid are particularly preferred for the present invention.

The complex bond in the complex salt compounds used in the toner of the present invention includes interaction much weaker than the complex bond in conventional complex compounds. From another viewpoint, such complex salt compounds used in the toner of the present invention can be guest-host compounds wherein the host (component) is a poly(—O—) ether and the guest (component) is a metal salt, and can also be high molecular compounds having a molecular weight of about 2000 to 5000.

The structure of the complex salt compound used in the toner of the present invention is estimated to involve a weak bond between a poly(—O—) compound and a metal salt (e.g., KSCN) as follows:

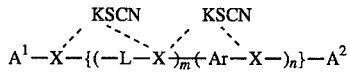

In the present specification, the complex salt compound in the toner of the present invention is hereinafter represented as follows:

$$A^1—X—[(—L—X—)_m—(—Ar—X—)_n]—A^2.\ KSCN$$

This complex salt compound is a white (colorless) solid having a positive charge providing property, obtained by heating with a salt or hydroxide (e.g., KSCN) in an amount of 1 equivalent per 1 to 10, preferably 1 to 5 units of (—L—X—) or (—Ar—X—) in formula [I]. The degree of charge providing performance varies depending on the structure of the poly(—O—) compound, the number of (—O—) bonds, the salt used for treatment and other factors. Examples of complex salt compounds which can be preferably used for the present invention are given below.

Group 1

Example Compound 1: Phenyl for $A^1$ and $A^2$, m=4, n=1

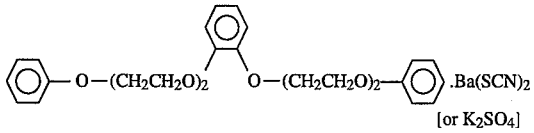

Example Compound 2: 8-quinoline for $A^1$ and $A^2$, m=2, n=1

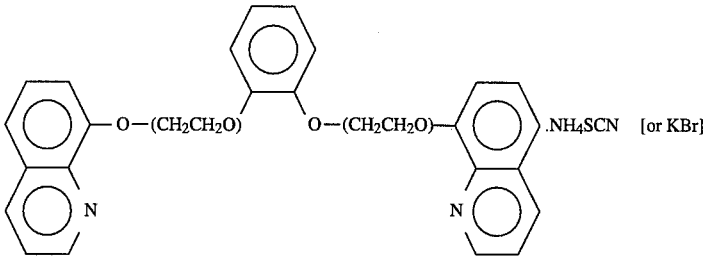

Group 2

Example Compound 3: $—CH_3$ for $A^1$ and $A^2$, m=6, n=0

$CH_3O—(CH_2CH_2O)_6—CH_3 \cdot Ba(SCN)_2$[or NaF]

Example Compound 4: 8-quinoline for $A^1$ and $A^2$, m=4, n=0

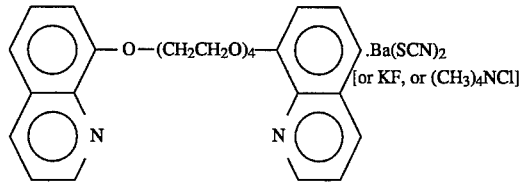

Group 3

Example Compound 5: 8-quinoline for $A^1$ and $A^2$, m=0, n=1

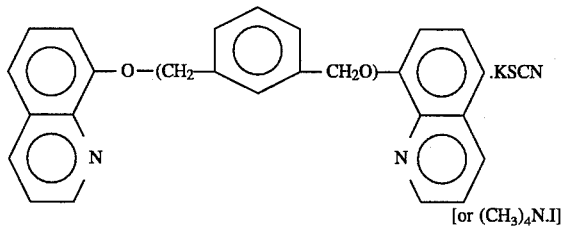

Example Compound 6: 8-quinoline for $A^1$ and $A^2$, m=2, n=1

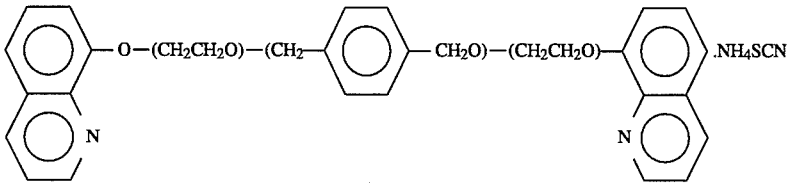

[or benzylmethyl-hexadecylammonium chloride]

Complex salt compounds for the present invention were synthesized by treating commercially available polyether compounds (e.g., polyethylene glycol derivatives) or poly(—O—) ether compounds synthesized by the methods described in the above-mentioned references, with organic or inorganic salts or hydroxides of the above-described alkali metals or alkaline earth metals, or ammonium thiocyanate. Examples of the synthesis are given below.

Synthesis Example 1

(Example Compound 4 [$Ba(SCN)_2$ complex salt])

290 g (2.0 mol) of 8-hydroxyquinoline, 280 g (1.2 mol) of diethylene glycol-di-(2-chloroethyl)ether, 120 g (2 mol) of potassium hydroxide and 100 g of n-butanol were refluxed for 6 hours.

After the solvent was distilled off, the residue was extracted with chloroform, washed with water and subjected to chromatography (silica, chloroform-methanol) to separate 16.6 g of a light yellow syrup (compound [a] of the following structure, yield 27%).

[a]

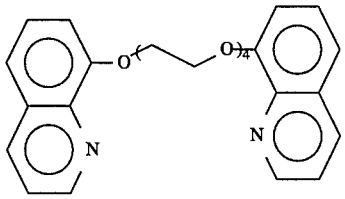

To 1.6 g (3.6 mmol)of compound [a] above, 1.0 g (3.6 mmol) of barium thiocyanate was added to yield a solid, which was then washed with acetone and recrystallized from acetone to yield 1.2 g (yield 45%) of a white powder represented by compound [a]·$Ba(SCN)_2$ (melting point 250°–252° C.).

Synthesis Example 2

(Example Compound 1 [$Ba(SCN)_2$ complex salt])

11.0 g (0.1 mol) of catechol, 2.6 g (0.2 mol) of 2-(2-chloroethoxy)ethanol, 14.0 g (0.25 mol) of potassium hydroxide and 60 g of n-butanol were refluxed for 4 hours.

After the solvent was distilled off, the residue was extracted with chloroform, washed with water and subjected to chromatography (silica, chloroform-methanol) to separate 4.7 g of a light yellow liquid (compound [b] of the following structure, yield 16.3%).

[b]

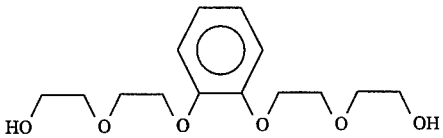

2.9 g (0.01 mol) of compound [b] above, 4.2 g (0.022 mol) of tosyl chloride (TsCl) and 50 g of dry pyridine were stirred in an ice bath for 10 hours. The reaction mixture was dispersed in 1 liter of water to obtain a white precipitate, which was then filtered and dried to yield 5.4 g (yield 90%) of compound [c] of the following structure.

[c]

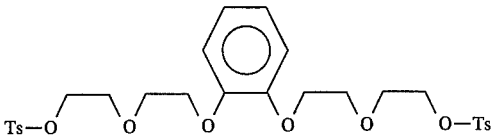

5.4 g (9 mmol) of compound [c] above, 4.2 g (20 mmol) of phenol and 20 g of dry DMF were stirred at room temperature for 10 hours. The reaction mixture was dispersed in 1 liter of water to obtain a white precipitate, which was then filtered and dried to yield 3.2 g (yield 75%) of compound [d] of the following structure.

[d]

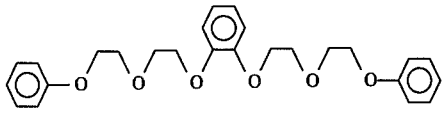

1.2 g (2.5 mmol) of compound [d] above and 0.6 g (2.5 mmol) of barium thiocyanate were mixed and heated to 100° C.; the mixture melted and then solidified. The solid was then recrystallized from acetone-benzene to yield 1.0 g (yield 55%) of a white power represented by compound [d] $Ba(SCN)_2$ (melting point 160°–180° C.).

Synthesis Example 3

(Example Compound 3 [$Ba(SCN)_2$ complex salt])

1.6 g (5 mmol) of hexaethylene glycol dimethyl ether and 1.5 g (5 mmol) of barium thiocyanate were mixed and heated to about 100° C.; the mixture solidified. This white solid was then washed with acetone and recrystallized from acetone to yield 0.59 g (yield 21%) of a colorless needle of the following structure (melting point 160°–162° C.).

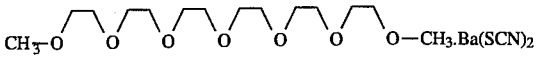

Synthesis Example 4

(Example Compound 5 [KSCN complex salt])

29.0 g (0.2 mol) of 8-hydroxyquinoline, 17.5 g (0.1 mol) of α,α'-di-chloro-m-xylene, 12.0 g (0.2 mol) of potassium hydroxide and 100 g of n-butanol were refluxed for 10 hours. After the solvent was distilled off, the residue was extracted with chloroform, washed with water and subjected to chromatography (silica, chloroform-methanol) to separate 9.2 g of a light yellow powder (compound [e] of the following structure, yield 24%).

[e]

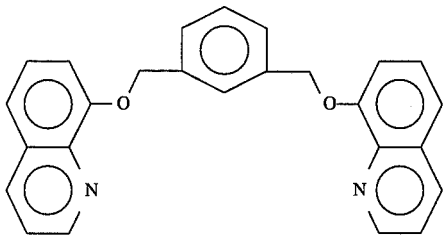

To 2.0 g (5 mmol) of compound [e] above, 0.5 g (5 mmol) of potassium thiocyanate was added, and the mixture was thermally molten and then cooled to yield a solid, which was then recrystallized from acetone-chloroform to yield 1.0 g (yield 40%) of a white powder represented by compound [e]·KSCN (melting point 178°–180° C.).

Synthesis Example 5

(Example Compound 6 [$NH_4SCN$ complex salt])

8-(2-hydroxyethyloxy)quinoline as obtained by reaction of 2-chloroethanol and 8-hydroxyquinoline was reacted with tosyl chloride in dry pyridine to yield the following compound [f].

[f]

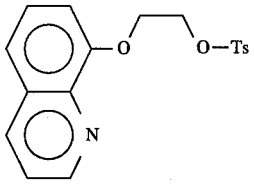

34.3 g (0.1 mmol) of compound [f] above, 6.9 g (0.05 mmol) of 1,4-benzenedimethanol and 30 g of dry DMF were stirred at room temperature for 24 hours.

After the solvent was distilled off, the residue was extracted with chloroform, washed with water and subjected to chromatography (silica, chloroform-methanol) to separate 16.0 g of a light yellow powder (compound [g] of the following structure, yield 62%).

[g]

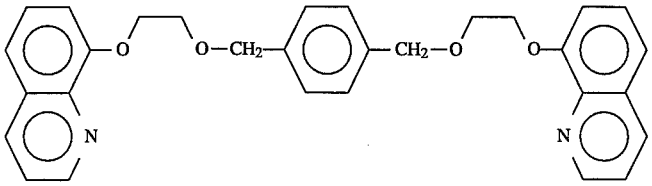

To 1.0 g (2 mmol) of compound [g] above, 0.15 g (2 mmol) of ammonium thiocyanate was added, and the mixture was thermally molten and then cooled to yield a solid, which was then recrystallized from acetone-chloroform to yield 1.1 g (yield 96%) of a white powder represented by compound [g]·$NH_4SCN$.

The positively chargeable toner for developing electrostatic images of the present invention preferably contains a (metal) complex salt compound as described above as a charge control agent in a ratio of 0.5 to 10 parts by weight, more preferably 1 to 5 parts by weight per 100 parts by weight of resin.

To improve toner quality, additives such as electroconductive grains, fluidity improving agents and image peeling preventing agents may be added internally or externally.

In addition, the (metal) complex salt compound used as a charge control agent may be used in combination with known positive charge control agents such as colored basic dyes (e.g., nigrosine dyes, triphenylmethane dyes) and colorless charge control agents (e.g., quaternary ammonium salts, polyamine resins), as long as their use does not interfere with the accomplishment of the object of the invention.

Examples of resins used in the toner of the present invention include the following known resins or binder resins for use in toners. Specifically, styrene resin, styrene-acrylic resin, styrene-butadiene resin, styrene-maleic acid resin, styrene-vinyl methyl ether resin, styrene-methacrylate copolymer, phenol resin, epoxy resin, polyester resin, polypropylene resin and paraffin wax may be used singly or in combination.

For preferable use of a resin or binder resin for toners in a toner used for full-color imaging by subtractive mixing or for OHP (overhead projectors) etc., the resin or binder resin is required to have special properties, for example, it should be transparent, substantially colorless (no tone damage occurs in the toner image), compatible with the charge control agent in the toner of the present invention, fluid under appropriate heat or pressure, and pulverizable. Examples of such resins for preferable use include styrene resin, acrylic resin, styrene-acrylic resin, styrene-methacrylate copolymer and polyester resin.

The toner of the present invention may incorporate various known dyes and pigments as coloring agents. Examples of such dyes or pigments which can be used in color toners include organic pigments such as carbon black, quinophthalone, Hansa Yellow, Rhodamine 6G Lake, quinacridone, Rose Bengale, copper Phthalocyanine Blue, copper Phthalocyanine Green and diketopyrrolopyrrole, various oil-soluble dyes or dispersion dyes such as azo dyes, quinophthalone dyes, anthraquinone dyes and phthalocyanine dyes, and triarylmethane dyes and xanthene dye modified with resins such as rosin, (rosin-modified) phenol and rosin-modified maleic acid.

The toner for developing electrostatic images of the present invention may incorporate the above-mentioned coloring agents singly or in combination.

Dyes and pigments having a good spectral property can be preferably used to prepare toners of the three primaries for full-color imaging. Chromatic monocolor toners may incorporate an appropriate combination of a pigment and dye of the same color tone, such as a quinophthalone pigment and dye, a rhodamine pigment and dye, or a phthalocyanine pigment and dye, as coloring agents.

The toner for developing electrostatic images of the present invention is, for example, produced as follows:

A toner having an average particle size of 5 to 20 μm can be obtained by thoroughly mixing a resin and coloring agent as described above, a (metal) complex salt compound as a charge control agent, and, if necessary, a magnetic material, a fluidizing agent and other additives, using a ball mill or another mechanical mixer, subsequently kneading the mixture in a molten state using a hot kneader such as a heat roll, kneader or extruder, cooling and solidifying the mixture, and then pulverizing the mixture and classifying the particles.

Other usable methods include the method in which the starting materials are dispersed in a binder resin solution and then spray dried, and the polymerizing toner production method in which a given set of starting materials are mixed in a monomer for binder resin to yield an emulsified suspension which is then polymerized to yield the desired toner.

When using the toner of the present invention as a two-component developer, development can be achieved by the two-component magnetic brush developing process or another process using the toner in mixture with a carrier powder.

Any known carrier can be used. Examples of the carrier include iron powder, nickel powder, ferrite powder and glass beads of about 50 to 200 μm in particle size, and such materials as coated with acrylate copolymer, styrene-acrylate copolymer, styrene-methacrylate copolymer, silicone resin, polyamide resin, ethylene fluoride resin or the like.

When using the toner of the present invention as a one-component developer, a fine powder of a ferromagnetic material such as iron powder, nickel powder or ferrite powder may be added and dispersed in preparing the toner as described above. Examples of developing processes which can be used in this case include contact development and jumping development.

EXAMPLES

The present invention is hereinafter described in more detail by means of the following examples, but these are not to be construed as limitative on the present invention. In the description below, "part(s) by weight" are referred to as "part(s)" for short.

Example 1

Styrene-acrylic copolymer resin [HIMER SMB600 (trade name), produced by Sanyo Kasei Co., Ltd.] . . . 100 parts Xanthene dye [Oil Pink #312 (trade name), produced by Orient Chemical Industries Ltd.] . . . 6 parts Example Compound 4 [$Ba(SCN)_2$ complex salt] . . . 3 parts The above ingredients were uniformly pre-mixed using a high-speed mixer, and then kneaded in a molten state using an extruder, cooled, and roughly milled in a vibration mill. The obtained coarse product was finely pulverized using an air jet mill equipped with a classifier to obtain a transparent magenta toner of 10 to 20 μm in particle size.

5 parts of this toner was admixed with 95 parts of an iron powder carrier [TEFV 200/300 (trade name), produced by Nippon Teppun Co., Ltd.) to yield a developer. This developer was found to be +15.0 μC/g in the amount of initial blowoff charges. When this developer was used for repeated actual imaging, fog-free distinct images with good charge stability and retention without image density loss were obtained.

Example 2

Styrene-acrylic copolymer resin [HIMER SMB600 (trade name), produced by Sanyo Kasei Co., Ltd.] . . . 100 parts Quinoline dye (C.I. Disperse Yellow 54) . . . 3 parts Example Compound 6 [$NH_4SCN$ complex salt] . . . 2 parts Quaternary ammonium salt [BONTRON P-51 (trade name), produced by Orient Chemical Industries Ltd.] . . . 0.5 parts The above ingredients were treated in the same manner as in Example 1 to yield a transparent yellow toner, which was then used to prepare a developer.

This developer was found to be +16.5 μC/g in the amount of initial blowoff charges. When this developer was used in repeated actual imaging, images of good quality as in Example 1 were obtained.

Example 3

Styrene-acrylic copolymer resin [HIMER SMB600 (trade name), produced by Sanyo Kasei Co., Ltd.] . . . 100 parts Triarylmethane blue dye [Oil Blue #613 (trade name), produced by Orient Chemical Industries Ltd.] . . . 5 parts Example Compound 5 [KSCN complex salt] . . . 3 parts The above ingredients were treated in the same manner as in Example 1 to yield a transparent blue toner, which was then used to prepare a developer.

This developer was found to be +14.0 μC/g in the amount of initial blowoff charges. When this developer was used in repeated actual imaging, images of good quality as in Example 1 were obtained.

Example 4

Styrene-acrylic copolymer resin [HIMER SMB600 (trade name), produced by Sanyo Kasei Co., Ltd.] . . . 100 parts Carbon black [MA-100 (trade name), produced by Mitsubishi Chemical Industries, Ltd.] . . . 5 parts Example Compound 4 [KF complex salt] . . . 3 parts The above ingredients were treated in the same manner as in Example 1 to yield a black toner, which was then used to prepare a developer. This developer was found to be +15.4 μC/g in the amount of initial blowoff charges. When this developer was used in repeated actual imaging, images of good quality as in Example 1 were obtained.

Example 5

Polyester resin [HP-301 (trade name), produced by The Nippon Synthetic Chemical Industry Co., Ltd.] . . . 100 parts Tri-iron tetroxide [EPT-500 (trade name), produced by Toda Kogyo Corporation] . . . 40 parts Low polymer polypropylene [Biscal 500-P (trade name), produced by Sanyo Kasei Co., Ltd.] . . . 10 parts Carbon black [MA-100 (trade name), produced by Mitsubishi Chemical Industries, Ltd.] . . . 6 parts Example Compound 1 [$Ba(SCN)_2$ complex salt] . . . 3 parts The above ingredients were uniformly pre-mixed using a ball mill to yield a premix, which was then kneaded in a molten state at 180° C. using a twin-screw extruder [PCM-30 (trade name), produced by Ikegai Seisakusho Co., Ltd.], cooled and thereafter roughly crushed, finely pulverized and classified to yield a one-component toner of 5 to 15 μm in particle size.

When this toner was used for a commercial copying machine to form toner images, fog-free high-quality images of good thin-line reproducibility were obtained, which had a solid portion reflecting density of 1.3.

Comparative Example 1

For comparison of chargeability, a magenta toner was prepared in the same manner as in Example 1, except that Example Compound 4 [$Ba(SCN)_2$ complex salt] used in Example 1 was replaced with tetramethylammonium chloride.

This developer was found to be +5.2 μC/g in the amount of initial blowoff charges. The chargeability of this developer lacked stability and durability.

Comparative Example 2

A black toner was prepared in the same manner as in Example 4, except that Example Compound 4 [KF complex salt] was not used. When this toner was evaluated as to performance in actual imaging in the same manner as in Example 4, image scattering, disturbance, fogging, etc. were noted, indicating that the requirements for toners were not satisfied.

In particular, in formula [I], as to L, the cycloalkylene group may have 3 to 7, especially 5 to 6, ring carbon atoms; as to Ar and Ax, each arylene group may have 6 to 10 ring carbon atoms such as phenylene and naphthylene and may be optionally substituted with at least one substituent such as lower alkyl, especially having 1 to 4 carbon atoms, halo, especially chloro, and nitro; and as to $A^1$ and $A^2$ each alkyl group may be lower alkyl, especially having 1 to 4 carbon atoms, each cycloalkyl group may have 3 to 7, especially 5 to 6 ring carbon atoms, each aryl group may have 6 to 10 ring carbon atoms such as phenyl and naphthyl and may be optionally substituted with at least one substituent such as alkyl having 1 to 8 carbon atoms, halo, especially chloro, and nitro, each aralkyl group may have an aryl moiety of 6 to 10 ring carbon atoms and an alkyl moiety of 1 to 4 carbon atoms such as phenyl alkyl and naphthyl alkyl, and each nitrogen-containing heterocyclic radical may be a pyridine radical, a quinoline radical or a carbazole radical.

What is claimed is:

1. A positively chargeable toner for developing electrostatic images which contains at least one complex salt compound, as a charge control agent, obtained by treating a compound represented by the following formula I with an alkali metal salt, alkaline earth metal salt, alkali metal hydroxide, alkaline earth metal hydroxide, ammonium salt or pyridinium salt:

$$A^1—X—[(—L—X—)_m—(—Ar—X—)_n]—A^2 \qquad \text{I}$$

wherein (—L—X—) represents an oxyalkylene group or a thioalkylene group, (—Ar—X—) represents an oxyarylene group or a thioarylene group, $[(—L—X—)_m—(—Ar—X—)_n]$ represents a combination of m units of (— L—X—) and n units of (—Ar—X—) bound in a given order, m and n independently represent an integer of 0 or more, and when n is 0, m is 3 or more, and when m is 0, n is 1 or more, X represents —O— or —S—, L represents an alkylene group having 1 to 4 carbon atoms which is branched or not branched or a cycloalkylene group, Ar represents a monocyclic or polycyclic arylene group which has or does not have a substituent, or a $—(CH_2)_a—Ax—(CH_2)_a—$ group wherein a represents an integer from 1 to 4 and Ax represents a monocyclic or polycyclic arylene group which has or does not have a substituent, and $A^1$ and $A^2$ independently represent hydrogen, an alkyl group, a cycloalkyl group, a monocyclic or polycyclic aryl group which has or does not have a substituent, an aralkyl group or a residue of a nitrogen-containing heterocyclic compound having an —OH group or an —SH group.

2. The toner for developing electrostatic images of claim 1 wherein the compound represented by formula [I] is a linear polyether or derivative thereof having (—L—X—) and (—Ar—X—) in the molecular structure thereof.

3. The toner for developing electrostatic images of claim 1 wherein the compound represented by formula [I] is a linear polyethylene glycol or derivative thereof having 3 or more units of (—L—X—) in the molecular structure thereof.

4. The toner for developing electrostatic images of claim 1 wherein the compound represented by formula [I] is a compound or derivative thereof having 1 unit of the component represented by the formula:

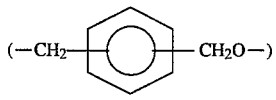

in the molecular structure thereof and a residue of a nitrogen-containing heterocyclic compound having an —OH group for $A^1$ and/or $A^2$.

5. The toner for developing electrostatic images of claim 1 wherein said alkali metal or alkaline earth metal salt and ammonium salt are salts of thiocyanic acid.

6. The toner for developing electrostatic images of claim 2 wherein said alkali metal or alkaline earth metal salt and ammonium salt are salts of thiocyanic acid.

7. The toner for developing electrostatic images of claim 3 wherein said alkali metal or alkaline earth metal salt and ammonium salt are salts of thiocyanic acid.

8. The toner for developing electrostatic images of claim 4 wherein said alkali metal or alkaline earth metal salt and ammonium salt are salts of thiocyanic acid.

9. The toner for developing electrostatic images of claim 1 wherein $A^1$ and $A^2$ are residues of a nitrogen-containing heterocyclic compound having an —OH group or an —SH group.

10. The toner for developing electrostatic images of claim 2 wherein $A^1$ and $A^2$ are residues of a nitrogen-containing heterocyclic compound having an —OH group or an —SH group.

11. The toner for developing electrostatic images of claim 3 wherein $A^1$ and $A^2$ are residues of a nitrogen-containing heterocyclic compound having an —OH group or an —SH group.

12. The toner for developing electrostatic images of claim 1 which comprises a coloring agent and a resin.

13. The toner for developing electrostatic images of claim 2 which comprises a coloring agent and a resin.

14. The toner for developing electrostatic images of claim 3 which comprises a coloring agent and a resin.

15. The toner for developing electrostatic images of claim 4 which comprises a coloring agent and a resin.

16. Positively chargeable toner for developing an electrostatic image, comprising a toner resin and a charge control effective amount of a positive charging charge control agent comprising a complex salt compound obtained by treating with an alkali metal salt, alkaline earth metal salt, alkali metal hydroxide, alkaline earth metal hydroxide, ammonium salt or pyridinium salt, a compound of the formula $$A^1—X—[(—L—X—)_m—(—Ar—X—)_n]—A^2 \quad [I]$$

wherein (—L—X—) represents an oxyalkylene group or a thioalkylene group, (—Ar—X—) represents an oxyarylene group or a thioarylene group, $[(—L—X—)]_m—(—Ar—X—)_n]$ represents a combination of m units of (—L—X—) and n units of (—Ar—X—) bound in a given order, m and n independently represent an integer of 0 or more, and when n is 0, m is 3 or more, and when m is 0, n is 1 or more, X represents —O— or —S—, L represents an alkylene group having 1 to 4 carbon atoms or a cycloalkylene group, Ar represents a monocyclic or polycyclic arylene group, or a $—(CH_2)_a—Ax—(CH_2)_a—$ group in which a represents an integer from 1 to 4 and Ax represents a monocyclic or polycyclic arylene group, and $A^1$ and $A^2$ independently represent hydrogen, an alkyl group, a cycloalkyl group, a monocyclic or polycyclic aryl group, an aralkyl group or a nitrogen-containing heterocyclic radical.

17. Toner of claim 16 wherein the compound of formula [I] is a linear polyether or derivative thereof having (—L—X—) and (—Ar—X—) in the molecular structure thereof.

18. Toner of claim 16 wherein the compound of formula [I] is a linear polyethylene glycol or derivative thereof having 3 or more units of (—L—X—) in the molecular structure thereof.

19. Toner of claim 16 wherein the compound of formula [I] is a compound or derivative thereof having 1 unit of the component represented by the formula

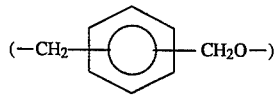

in the molecular structure thereof and a nitrogen-containing heterocyclic radical for at least one of $A^1$ and $A^2$.

20. Toner of claim 16 wherein the alkali metal salt, alkaline earth metal salt or ammonium salt is a salt of thiocyanic acid.

21. Toner of claim 16 wherein $A^1$ and $A^2$ are nitrogen-containing heterocyclic radicals.

22. Toner of claim 16 further comprising a coloring agent.

23. Toner of claim 16 wherein the charge control agent is present in an amount by weight of about 0.5 to 10 parts per 100 parts of the resin.

24. Toner of claim 16 wherein with respect to L, the alkylene group is optionally branched, and the cycloalkylene group has 3 to 7 ring carbon atoms, with respect to Ar and Ax, each arylene group has 6 to 10 ring carbon atoms and is optionally substituted with alkyl having 1 to 4 carbon atoms, halo or nitro, and with respect to $A^1$ and $A^2$, each alkyl group is a lower alkyl group, each cycloalkyl group has 3 to 7 ring carbon atoms, each aryl group has 6 to 10 ring carbon atoms and is optionally substituted with alkyl having 1 to 8 carbon atoms, halo or nitro, each aralkyl group has an aryl moiety of 6 to 10 carbon atoms and an alkyl moiety of 1 to 4 carbon atoms, and each nitrogen-containing heterocyclic radical is a pyridine radical, a quinoline radical or a carbazole radical.

* * * * *